US005722893A

United States Patent [19]

Hill et al.

[11] Patent Number: 5,722,893

[45] Date of Patent: Mar. 3, 1998

[54] CARD DISPENSING SHOE WITH SCANNER

[75] Inventors: Otho D. Hill, Las Vegas, Nev.; Louis W. DesPrez, Cupertino, Calif.

[73] Assignee: Smart Shoes, Inc., Las Vegas, Nev.

[21] Appl. No.: 543,908

[22] Filed: Oct. 17, 1995

[51] Int. Cl.[6] ..... A63F 1/14

[52] U.S. Cl. ..... 463/47; 463/29; 273/149 R

[58] Field of Search ..... 463/23, 29, 46, 463/47, 11, 12; 273/292, 148 R, 149 R, 149 P

[56] References Cited

U.S. PATENT DOCUMENTS

| | | | |
|---|---|---|---|
| 4,531,187 | 7/1985 | Uhland | 476/12 |
| 5,259,907 | 11/1993 | Soules et al. | 273/293 |
| 5,362,053 | 11/1994 | Miller | 273/309 |
| 5,374,061 | 12/1994 | Albrecht | 273/149 R |
| 5,382,024 | 1/1995 | Blaha | 273/149 R |
| 5,416,308 | 5/1995 | Hood et al. | 235/454 |
| 5,515,477 | 5/1996 | Sutherland | 395/27 |

FOREIGN PATENT DOCUMENTS

| | | | |
|---|---|---|---|
| 3807127 | 9/1989 | Germany | 273/148 R |

*Primary Examiner*—Jessica Harrison
*Assistant Examiner*—James Schaaf

[57] ABSTRACT

The present invention is directed to a shoe of the type described wherein the shoe has a card scanner which scans indicia on a playing card as the card moves along and out of a chute by manual direction by the dealer in the normal fashion. The scanner can be one of several different types of devices which will sense each card as it is moved downwardly and out of the shoe. A feed forward neural-network which is trained using error back-propagation to recognize all possible card suits and card values sensed by the scanner. Such a neural-network becomes a part of a scanning system which provides a proper reading of the cards to determine the progress of the play of the game including how the game might suffer if the game players are allowed to count cards using a card count system and perform other acts which would limit the profit margin of the casino. The shoe of the present invention is also provided with additional devices which make it simple and easy to record data relevant to the play of the game. For instance, the shoe has means for accommodating a "customer-tracking-card" or preferred customer card which reads the personal information of a card holder from a magnetic stripe on the card and this information travels with the preferred customer from game to game, throughout a casino, which the customer likes to play. An LCD display can also be part of the shoe and this display can be used to enter and retrieve vital player information as deemed necessary or desirable to the customer file opened when the magnetic stripe reader reads the preferred customer card with the customer name and account number embedded within the cards magnetic stripe.

11 Claims, 8 Drawing Sheets

CARD DISPENSING SHOE WITH SCANNER

This invention relates to improvements in the dealing of cards and, more particularly, to a shoe used to hold a deck of cards and to allow the card values to be identified as the cards are dealt one-by-one from the shoe.

BACKGROUND OF THE INVENTION

Shoes used for delivering cards have been known and used for a number of years in the past. In such a shoe, a deck of cards is placed in an opening at the top of the shoe during the play of a game and the shoe is situated near a dealer's station at a card game table. The dealer feed the cards by manually engaging and forcing the top card of the deck through a feed slot at the front of the shoe. The top card of the deck is then pulled from the deck and delivered or dealt to a game player. In this way, a series of cards are delivered, one-by-one, to the players of the card game until the players all have the requisite number of cards to play the game. The shoe is in the view of the dealer and the game players, and neither the players nor the dealer are aware of the cards value or suit since they are not observable at any time during the play of the game while the cards are in the shoe.

While shoes of this type are adequate for delivering cards one-by-one to game players of a card game, there is room for improvement, especially if there are to be checks made on the play of the game to assure that the cards are not being counted or tracked by professional card count system counters, or that other activities are not being pursued which would affect the profit margin of the casino or the gaming location where the card game is being played. Thus, a casino operator must always be concerned about how the cards can be traced without sacrificing the element of chance in the play of the game. The present invention is directed to improvements in the shoes of the type described to offset any activity on the part of the game players in practicing methods which are inimical to the fair play of the game.

SUMMARY OF THE INVENTION

The present invention is directed to a shoe of the type described wherein the shoe has a card scanner which scans indicia on a playing card as the card moves along and out of a chute by manual direction by the dealer in the normal fashion. The scanner can be one of several different types of devices which will sense each card as it is moved downwardly and out of the from of the shoe. A feed forward neural-network trained using error back-propagation which is coupled to the scanner is trained to recognize all possible card suits and values sensed by the scanner. Such a feed forward neural-network trained using error back-propagation becomes a part of a scanning system which provides a proper reading of the cards to determine the precise value of cards removed from the deck and the progress of the play of the game including how the game might suffer if the game players are allowed to use a card count system to count and keep track of the cards as they are removed from the deck and perform other acts which would limit the profit margin of the casino.

The shoe of the present invention is also provided with additional devices which make it simple and easy to record the play of the game and record other information specific to the players of the game. For instance, accommodated within the shoe is a "magnetic stripe reader" which reads the personal information of a "customer-tracking-card" or a preferred casino customer card holder from a magnetic stripe on the card when the card is inserted into the "magnetic stripe reader" and this information travels with the preferred customer from game to game, throughout a casino, which the customer likes to play. Liquid crystal displays (LCD) can also be part of the shoe and these displays can be used to enter, retrieve and read vital player information deemed necessary or desirable to computer files assigned to the card holder that will be opened when the magnetic stripe of the preferred customer card is read.

The primary object of the present invention is to provide an improved shoe for delivery and tracking of cards from a deck of playing cards situated in the shoe wherein the shoe has a scanner for scanning the value and suit of the cards as they are delivered one-by-one by the dealer out of the shoe and to the game players of a card game whereby the trend of the game can be sensed and determined by analyses of the cards removed from the deck and the play of the cards so that questionable tactics used by one or more game players can be remedied.

Other objects of the present invention will become apparent as the following specifications progresses, reference being had to the accompanying drawings for an illustration of the invention.

DESCRIPTION OF THE PREFERRED EMBODIMENT

Figure 3:
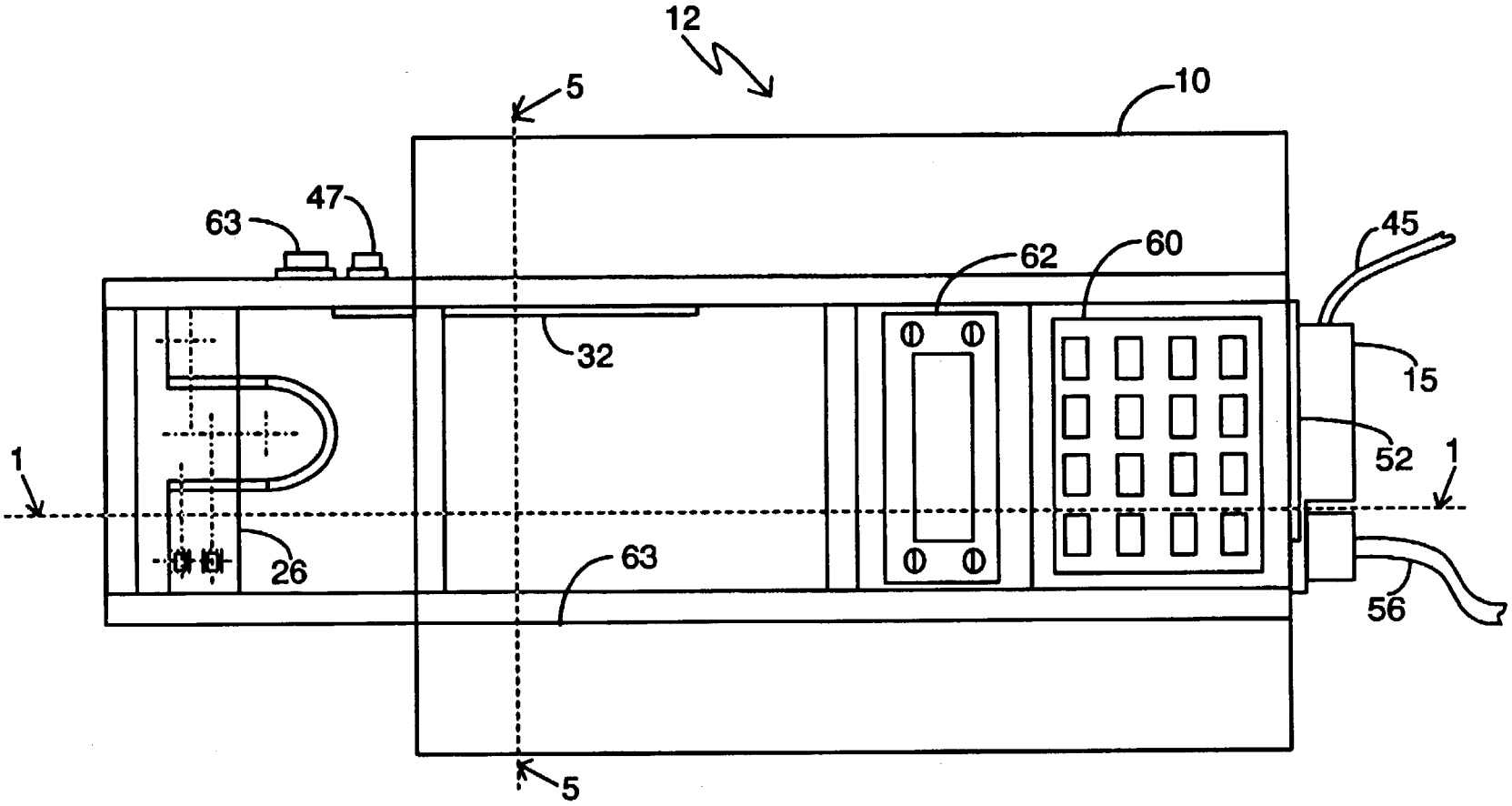
FIG. 3 is a top plan view of the shoe of FIG. 1.
Figure 4:
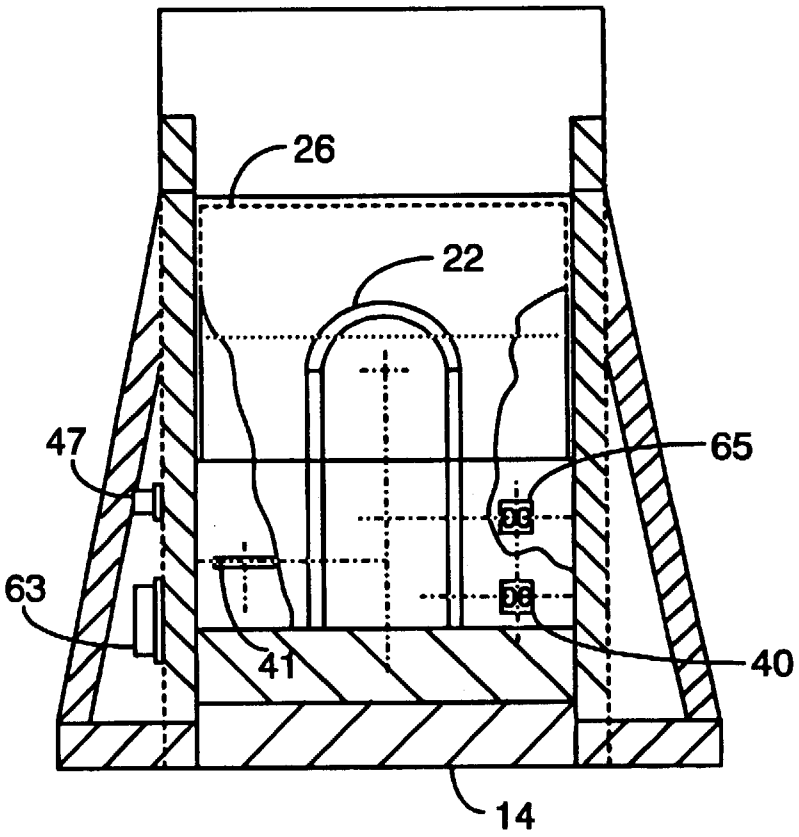
FIG. 4 is a front elevational view of the shoe, showing the delivery under the shoe.

The card delivery shoe of the present invention is broadly denoted by the numeral 10 in FIG. 3 and is formed of a container or housing 12 (also in FIG. 3) which has a lower surface 14 (FIG. 1 & 4) adapted to rest and be supported on a game table or other flat surface. Shoe 10 is conventional in that it has a means for supporting a deck 16 (FIG. 1) of playing cards in a chute. Typically, a dealer operates the shoe in that the dealer forces downwardly on the top card of the deck and with a forward movement of the deck in the box 12, the top card is forced into and through a slot or opening 22 and onto a playing surface shown in FIG. 4.

In playing a card game, the dealer forces the cards one-by-one out of the deck and to the various players, such as the players of a Blackjack or Baccarat game. It has been know for many years that a card delivery shoe of the type described above can be used to deliver each card one-by-one to the various players and the dealer of the deck of cards in playing a card game.

Shoe 10 has an optical sensor 41 (FIG. 1, 2 & 4) which is adapted to determine the card value and the suit of the card as the card dealer slides the card down the chute along the front surface of the shoe. The optical sensor is illuminated with a lamp or bulb 42 (FIG. 1, 2) so that the card will be well lit as it passes the optical sensor.

A typical optical sensor to be used as a scanner is a "charge mode" 128×1 integrated opto-sensor made by Texas Instruments, part no. TSL215.

The shoe can be made to hold one two, four, six, eight or more decks of playing cards. Each playing card in a deck is placed face down into the open top of the shoe 10 on a 45 degree chute which slopes forwardly. A hollow wedge-shaped block housing mounted on a heavy stainless steel roller (not show), measuring the full width of the chute, is placed behind the decks of cards to force the cards forwardly down the chute and flush against a retainer that forms an opening at the slot 22 of the shoe. The retainer is broadly denoted by the numeral 26 in FIG. 3 & 4. The top card of the deck of cards, flush against the retainer 26 with a portion of its back exposed at the slot 22 of the shoe, may or may not be covered by a door or brush.

A card dealer will manually remove a single card from the shoe by pushing the door (not shown) up or down or through a brush (also not shown). Then the dealer pushes the exposed card down and out of the opening of the slot 22 of the shoe. As each card is pushed down the chute and out the opening of the slot of the shoe (such opening being denoted by the numeral 22 in FIG. 4), it will pass over and physically come in contact with a scanner 41 and the card will come into physical contact with a start frame sensor 65 (FIG. 4) to activate the scanner.

The scanner could be any one of a number of different devices, such as the following: An infrared laser scanner capable of reading a "bar code" imprinted on the cards; an opto-sensor capable of scanning the card image to be used with a neural network that can recognize the images printed on the face of the cards; an infrared laser scanner with an optical character recognition (OCR) reader; a charged coupling device (CCD) laser capable of capturing and recognizing the images printed on the face of each card; or a infrared camera that will photograph the card images as the cards pass over the optical ends of the scanner as it leaves the shoe.

A specific bar code or image, for instance, will be assigned to each card in the deck. When a bar code or image is captured and identified by the scanner, that information will be transmitted to a remote computer that will be programmed to:

1. Assign a specific numeric value (1–10), card suit and card count system value (0, +/−1–10) to each card passed over and identified by the scanner;
2. Keep track of the number of cards played from and remaining in each suit of the deck;
3. Keep track of the each of the card values played from and remaining in each suit of the deck;
4. Convert each of the card values played from the deck being dealt to a "card count value" and calculate and display the running and true counts as each card is removed from the deck and at the beginning of each round during real time;
5. Alert and display to the user on a remote computer monitor the running and true counts at the beginning of a round to be dealt when a specific percentage of the deck has been or remains to be dealt;
6. Calculate and display the maximum and minimum and average running and true counts at the beginning of each round to be dealt for all decks dealt from a shoe during a specific time period;
7. Activate and alert a display light on the shoe to inform the dealer that the house deck penetration has been achieved and this will be the last round dealt from the shoe before the deck is shuffled; and
8. Calculate a player's proficiency when playing a specific card count system.

When a true count alert occurs, the computer operator will call an independent VCR display for the game on which the shoe has been placed. The purpose of this is to observe the players' response. If a player seated at a Blackjack or Baccarat table for which the alert has been activated is responding to a positive count at the beginning of a round by increasing or decreasing his bet, the computer operator will make note of that fact and pass this information on to the casino game supervisors on the casino floor.

The information will enable the user and casino supervisors to identify individuals and teams of suspected professional card count system players and suspected "shuffle-trackers." The casino then may choose to take the appropriate action to protect themselves from such players to prevent unwanted table losses, thus saving the casino substantial amounts of money.

Other components of the shoe 10 include a round start button 63 (FIG. 1, 3 & 4) which is pressed to record the start of a particular round of cards to be dealt from a deck within the shoe. A load switch 32 (FIG. 1 & 3) senses the placement or absence of cards in the shoe and activates or deactivates the operation of the system.

Figure 1:
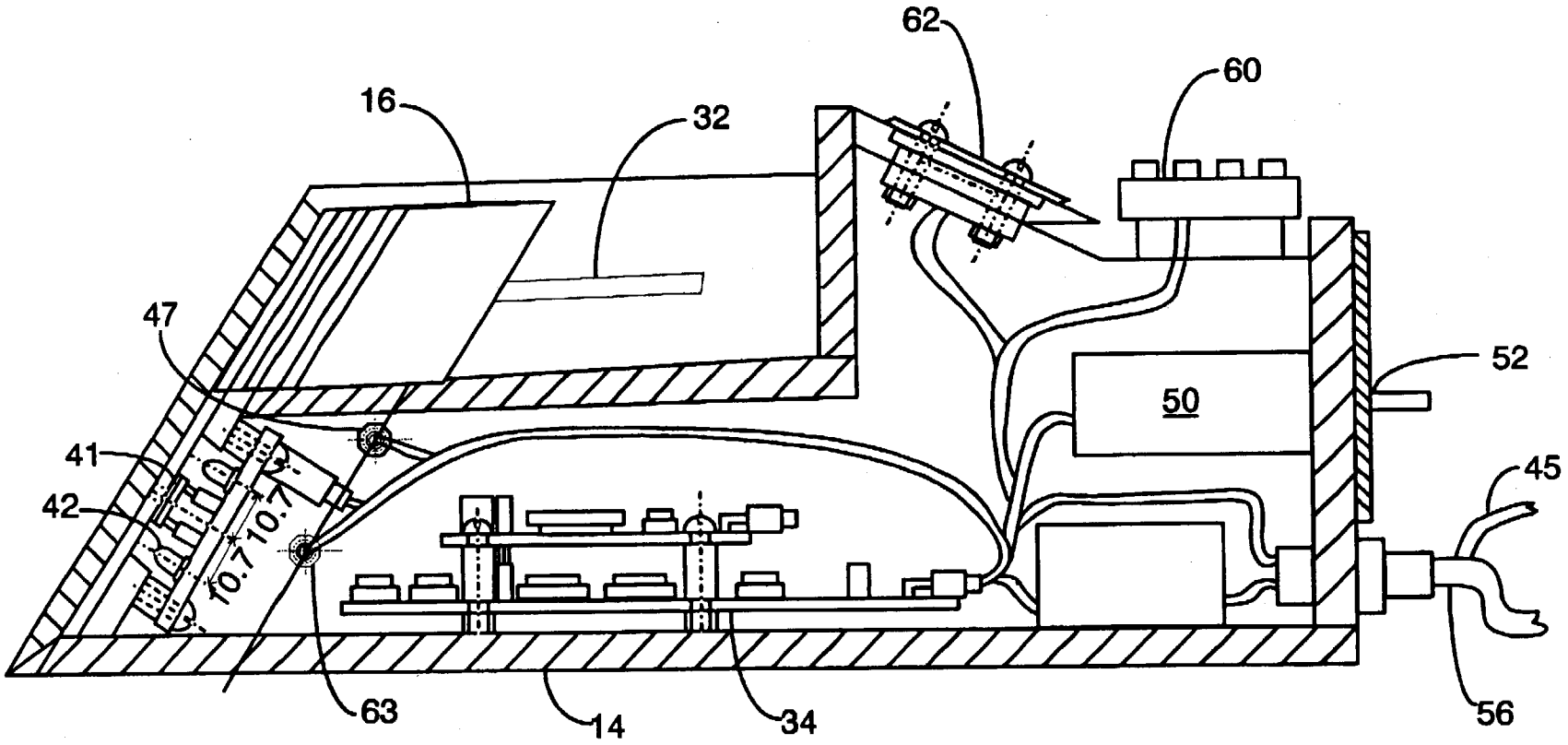
FIG. 1 is a vertical section taken along line A—A of FIG. 3.
Figure 2:
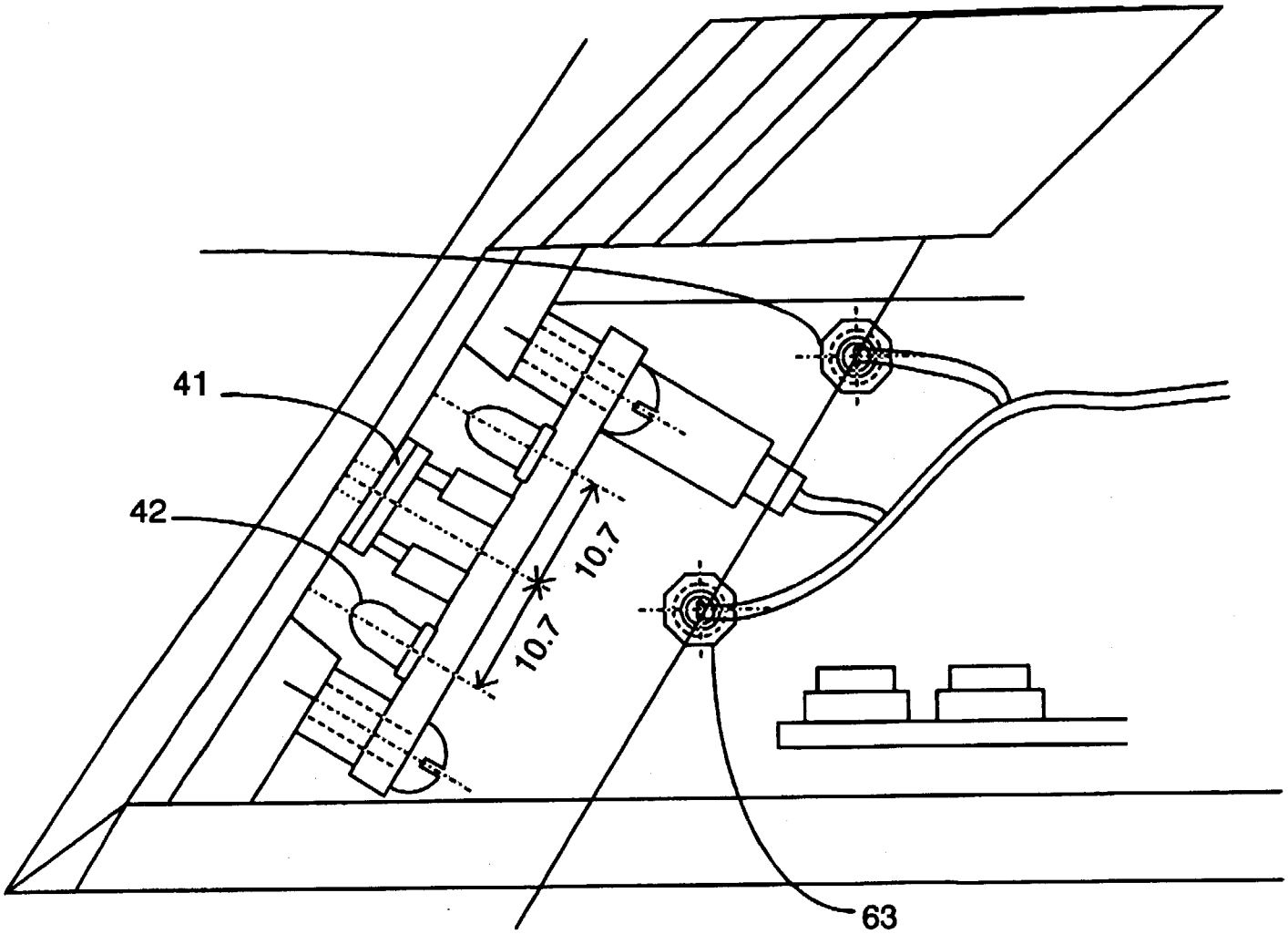
FIG. 2 is a side elevational view, partly schematic, of the card delivery shoe of the present invention.

A "charge-mode" 128×1 integrated opto-sensor 41 (Texas Instruments part number TSL215), will be utilized to capture the card value and suit as the dealer slides the card down the front surface of the shoe. The card will be illuminated using a 750 μm light source 42 (FIG. 1 & 2).

Figure 5:
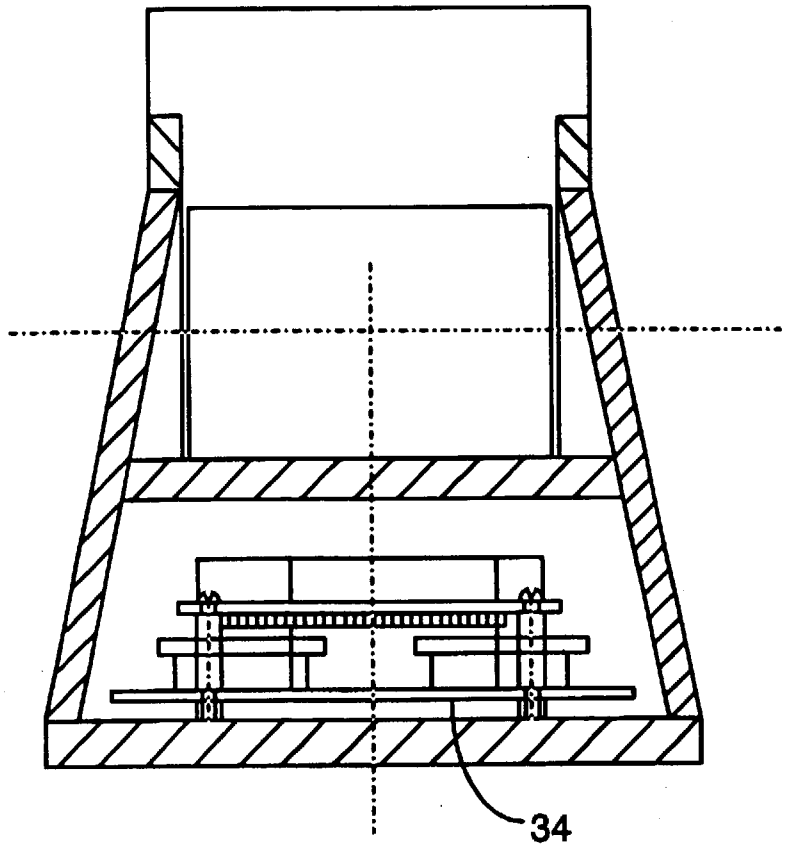
FIG. 5 is a vertical section taken along line B—B of FIG. 3.

As the card slides down the from surface of the shoe the start-frame sensor 65 (FIG. 4) detects the leading edge of the card and will generate a frame-mad interrupt. This interrupt will start sending the serial data from the opto-sensor 41 via a serial data port to RAM memory located on the single board computer 34 (FIG. 1 & 5). Prior to the sensor data reaching the serial data port, the analog opto-sensor 75 (FIG. 6) serial output data will be thresholded to a binary value. As long as the frame-read interrupt line is at a logic high the serial image bit stream will continue to be written to the single board computer memory 34 (FIG. 1). This will create a two dimensional bit-mapped image of the card suit and value of the particular card under scrutiny.

Shoe 10 further includes a frame-stop sensor 40 (FIG. 4) which senses the leading edge of the card. When the frame-stop sensor 40 senses the leading edge of a card, it will cause the frame-read to go to a logic low and stop the writing of the serial-bit stream to memory. At this point the entire bit-mapped card image will be stored in the RAM memory of the single board computer 34.

Next, this bit-mapped image will be used as a input vector for a feed forward neural network to be run on the single board computer 34. The neural network will be tried using error back-propagation to recognize all the possible suits and values of the cards passing through the shoe 10.

Figure 6:
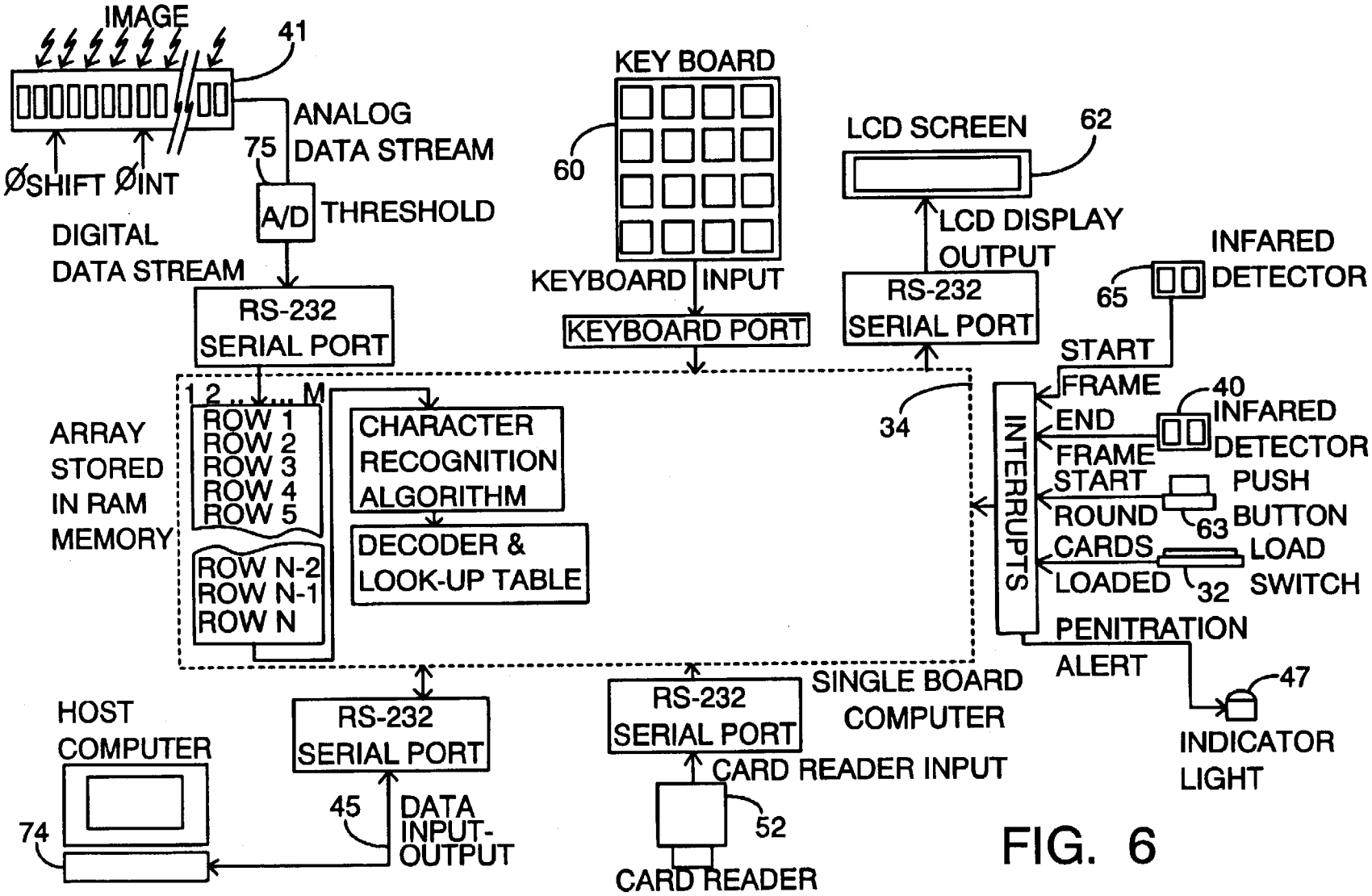
FIG. 6 is a system block diagram of the shoe electronics

The resulting character recognition output will be converted to ASCII format and then transmitted to the host computer for processing by way of the LAN port 45 (FIG. 6).

When the single board computer 34 of the shoe 10 has predetermined that deck penetration has been reached, it will illuminate a penetration alert light denoted by the numeral 47 in FIG. 1, 2, 3, & 4.

Shoe 10 accommodates a "customer-tracking-card" 15 (FIG. 3) of a particular player or players. To this end, a magnetic card reader 50 (FIG. 1) having a slot 52 (FIG. 1 & 3) is provided on the shoe 10 at the rear end thereof adjacent to and below the alfa-numeric keyboard 60 (FIG. 1 & 3). Power is supplied by a cable 56 (FIG. 1 & 3) to the computer 34 and to the magnetic card reader 50 and to the load switch 32, and to the penetration light 47 and to the card illumination light source 42 and to the round start button 63 and to the opto-sensor 41 and to the start-frame sensor 65 and to the stop-frame sensor 40. As a player plays the game, the player's data field recorded in the "customer-tracking-card's" magnetic stripe will transfer to the single board computer memory as a data file. As the player continues to play, the data field of the player will be updated. When a player quits the game casino personnel will log the player out of the game using the alpha-numeric keyboard 60, the data field will be updated, transferred to the host computer 74 (FIG. 6), and its local data file will be closed until it is opened once again by the insertion of the "customer-tracking-card" when it is inserted into the magnetic stripe reader slot 52 when the player engages in another session or game in the casino holding the information, or it is opened by an authorized user.

If a "customer-tracking-card" 15, as show in FIG. 3, is used to log in a participant of a game, the card will have a magnetic stripe. The magnetic stripe reader 50 can be built into and joined with the shoe 10. The host computer 74 will be connected to the shoe's microprocessor with a wireless modem contained within the shoe 10, or by a "hard-wired" LAN connection. When a customer "customer-tracking-card" 15 embedded with the customer account number is inserted within the magnetic card reader 50, the customer's information file stored on a remote CPU will be called. The customer name and account number embedded in the magnetic stripe of the "customer-tracking-card" will be displayed on the LCD (liquid crystal display) keyboard display 62 (FIG. 1 & 3). Casino personnel can then verify the customers' identification by using specific keyboard key functions that can be used to sequentially access specific fields within the customer's file and to enter data to or retrieve data from the file as deemed necessary or desirable. Such information can be as follows:

1. Address
2. Date of birth
3. Social Security number
4. Credit line
5. Cash on deposit
6. Win
7. Loss
8. Average Bet
9. Start/Stop Time
10. Length of Play
11. Card Count Strategy Proficiency
12. Comp Equivalency/Recommendations
13. Cash Transaction Reporting The names of the customer possessing the "customer-tracking-card" 15 will automatically be logged to a specific game table. By means of the keyboard 60 the user or casino personnel can then log in that customer as playing in a specific seat. Once the customer is logged to a specific seat at the game table, the "customer-tracking-card" 15 is removed from the reader and the seat number played by that customer and entered by casino personnel will light up on the keyboard 60 and remain lit until such time as the casino personnel enter the customer's minimum and maximum and average bets and then log out or dose the customer's file.

When a "customer-tracking-card" 15 assigned to a specific casino customer is used to log that customer in at a particular gaming table, the last date and the time and the code number for any complimentary room, food, or beverage given to that customer can be displayed by means of the LCD display 62. Casino personnel can then use this information to base their decisions to honor any requests by the customer for comps. If granted, those comps will be entered by the user and the comp information file will be immediately updated on the remote CPU. If a customer attempts to get duplicate or unauthorized comps from other casino personnel, that information will immediately be available. The account number or identification number of the person authorizing the comps will be assigned to the "customer-tracking-card" customer's information file by means of the keyboard 60.

Duplicate stripe readers coupled with microprocessors linked to the remote CPU with a housing other than the card dispensing shoe 10 are also to be placed on all the table games and in all restaurants and hotel desks. When a customer uses his or her comp authorization, the "customer-tracking-card" 15 will be placed in the magnetic stripe reader slot 52 and the amount of the comp and the department to which it is charged will be assigned to the customer's information file or account.

If a wireless modem is to be used to transfer data, some form of encryption is to be installed in the microprocessor chip of the single board computer. The purpose of this strategy is to protect the confidentiality of the data and prevent its unauthorized interception.

To avoid reverse engineering some part of the circuitry, and a dummy microchip is embedded in plastic to deter copying the circuitry of the shoe 10.

The keyboard 60 and the LCD 62 are to be used to receive, transmit, and display information to or from the single board computer. The keyboard and LCD also will be used to log in dealers and casino pit personnel associated with the game in progress.

A transparent window (not shown) can be provided on the right side of the shoe 10 thereof to allow the dealer and casino personnel to see approximately how many cards remain in the deck in the shoe to be dealt. A penetration light 47 is a light that will come on to notify the dealer that deck penetration (cards to be dealt before shuffling) has been reached and that this is to be the last round dealt from this particular shoe before shuffling.

At the end of each round, the dealer will press the beginning of round button 63 (FIG. 1, 2, 3 & 4) to cause the program to record that a new round is about to begin and to display the true count of the card count system the program is using to monitor the true count of decks being dealt from the shoe at that time on a remote computer monitor 74. The load switch 32 will record that the deck has been shuffled and placed in the card chute of the shoe and that a new deal is about to begin. The ruing and true counts are always zero or reset to zero at the beginning of a new deal. Until the load switch is activated and the first "burn" card is passed over the scanner, the beginning of round button will not react.

In operation, a wedge-shaped block mounted on a heavy stainless steel roller (not shown) in a first position indicates that no cards are in the shoe. When the cards are placed in the shoe, the wedge-shaped block will be placed behind the cards and it and the cards will press against the load switch. The weight of the wedge-shaped block and the roller it is mounted on will force the cards placed in the shoe to the forward slot 22 which is covered by a door (not shown). The dealer will then push the door up and the top card of the deck forward and down passing over the start-frame sensor switch 65, across the infrared or optical scanner 41 and over the stop-frame sensor switch and down through the bottom of the slot 22 for delivery by the dealer to the players. A load switch 32 will be placed in the inside of one wall of the shoe above the floor of the chute facing forwardly. When the chute is empty, cards have not been placed in the shoe. The load switch 32 is fully extended and the load switch is inactivated. When cards have been placed into the card chute, (not shown) the load switch will be recessed into the wall of the shoe. If the wedge-shaped housing mounted over and attached to the stainless steel roller is placed in the card chute by itself, it will not activate the load switch. The load switch will not activate until it has been recessed for three seconds. The deck of cards is in place in the top of the shoe and they will press against the load switch to activate the load switch and signal the computer program that a new deck has been placed in the shoe and that a new deal is about to begin. The roller housing will press against the load switch also. Any time that all the cards have been dealt or removed from the card chute, the weighted roller will be positioned forward of the load switch and the load switch will be deactivated and the computer program will end its calculations for the current deck.

The shoe has a door (not shown) in the front end thereof to prohibit a player from viewing the top of the next card to be dealt before it is dealt. This will prevent players from identifying any identifying marks the cards may have occurring intentionally or unintentionally. When a card is to be dealt from the shoe the dealer pushes the door up and then pushes the top card of the deck down and out the opening 22 at the front of the shoe 10. Some casino shoes are equipped with doors or brushes. Others use only a small finger-sized heel opening. As to the scanner switch optical sensor, when a source of light is cut off it will activate the scanner viewing area. An opto-sensor or other type of scanner will capture the image of the cards as the cards pass over the scanner.

The circuit processor boards shown in detail in FIG. 1 identified by the numeral 34 will carry the microprocessor and microchips and other components of the scanner. The circuit processor boards will be housed in the empty space below the bottom of the card chute within the shoe. The bottom of the shoe will be transparent.

As each card moves down the chute of the shoe and is fed out of the opening 22 at the front of the shoe, the scanner 41 scans the card and determines its value and suit. The card is directed by the dealer to the respective players and the game proceeds in a normal fashion until all the cards have been dealt out for a particular round of the game. Then additional rounds can be played until the penetration level is reached as the cards have been depleted in the shoe. The deck of cards is then shuffled and restocked in the shoe and the play of the game continues.

The following is a description of how the feed forward neural network will identify playing card suit and values:

The high resolution array stored in memory will be reduced to a course image that is an array size of 6 columns by 7 rows. This will be accomplished by sectioning the larger high resolution array into a 6 by 7 grid and assigning the course array a gray scale value that is based on the number of black pixels in each grid. If all of the pixels in a grid are black the gray scale will be 100% (black), if all of the pixels are white the gray scale will be 0% (white), and if half of the pixels are black the gray scale will be 50% (gray).

The 6 by 7 course array that is stored in memory will now be converted into two 42 word vectors. One for the card value input vector and one for the card suit vector. These vectors will now be used as inputs to the neural network's input layer.

Figure 7:
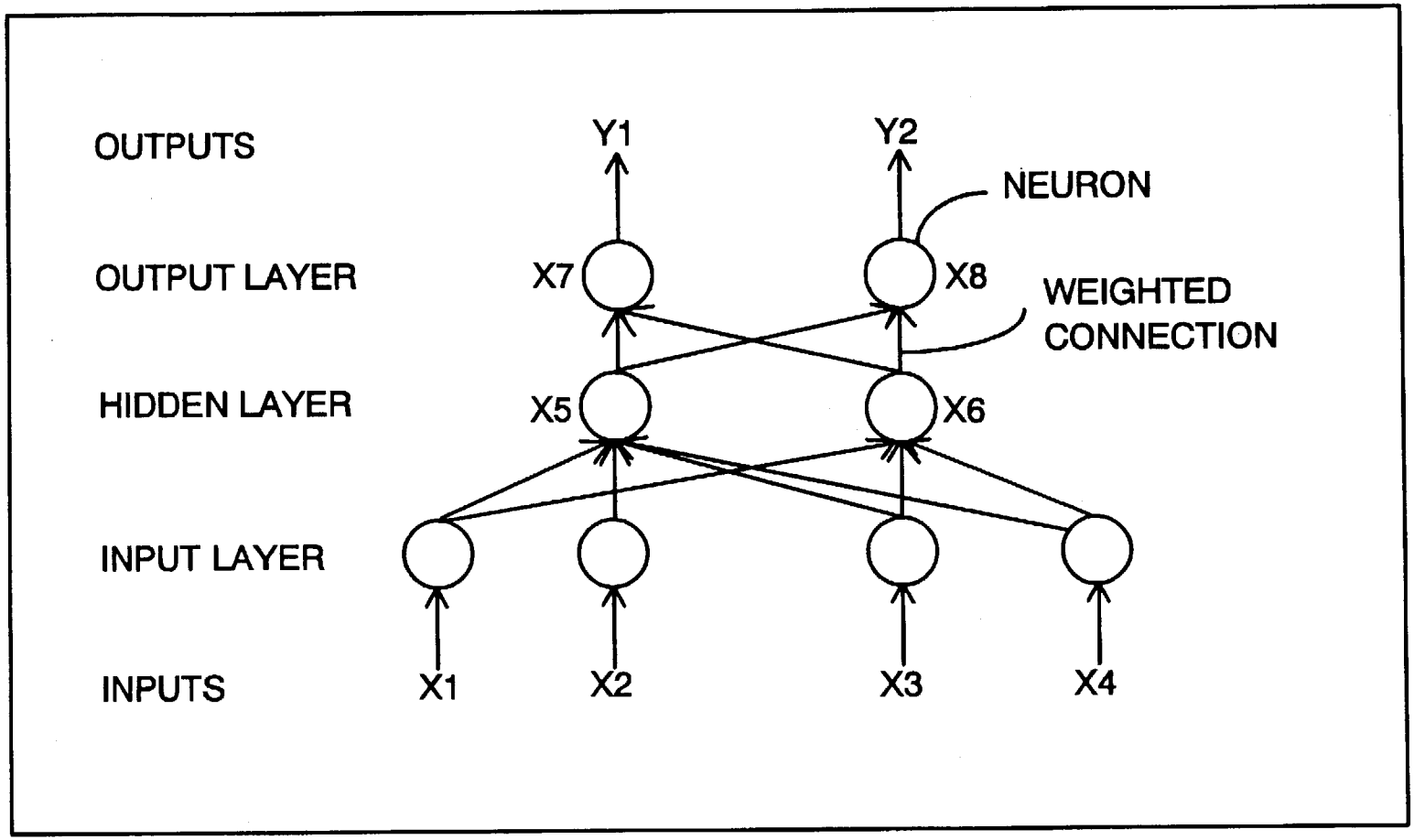
FIG. 7 is a schematic view of a 3-layer feed forward multilayer perception.

The type of neural network to be used in this application will be a feed forward multilayer perception (MLP) that will be trained for image recognition using back-propagation (see FIG. 7). The neural network consists of neurons and "weighted" connections between the neurons.

The equations used to describe the operation of the basic 3-lay feedforward multilayer perception are as follows:

$$\text{for } I=m+1 \text{ to } N+1$$

$$net_I=\Sigma_{j<I} W_{ij}*xj$$

$$x_j=\text{logsigmoid}(\text{net}_i)$$

$$Y_i=x_{i+N}(x_0-1)$$

Figure 8:
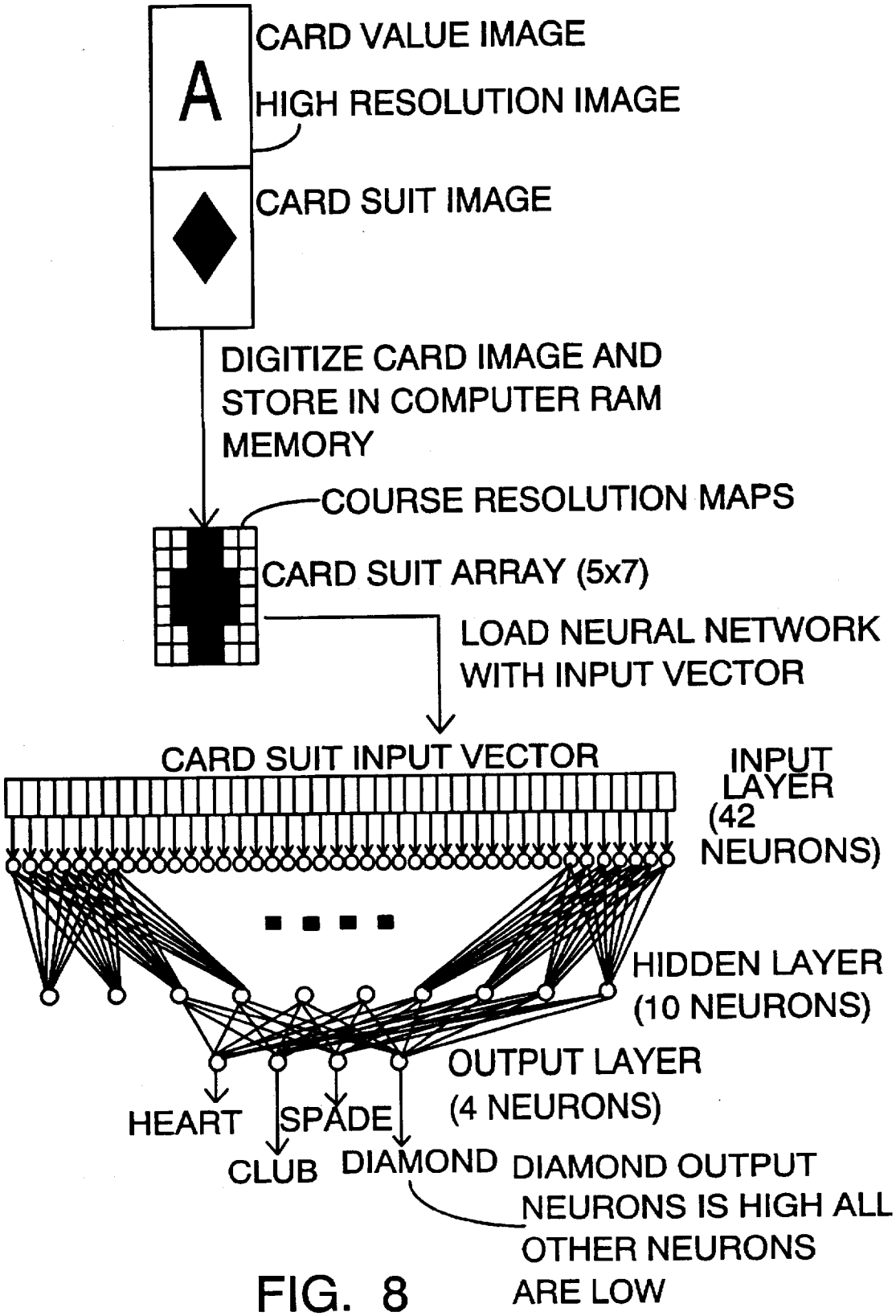
FIG. 8 and FIG. 9 are schematic views of feed forward neural networks for card suit identification and card value identification respectively.
Figure 9:
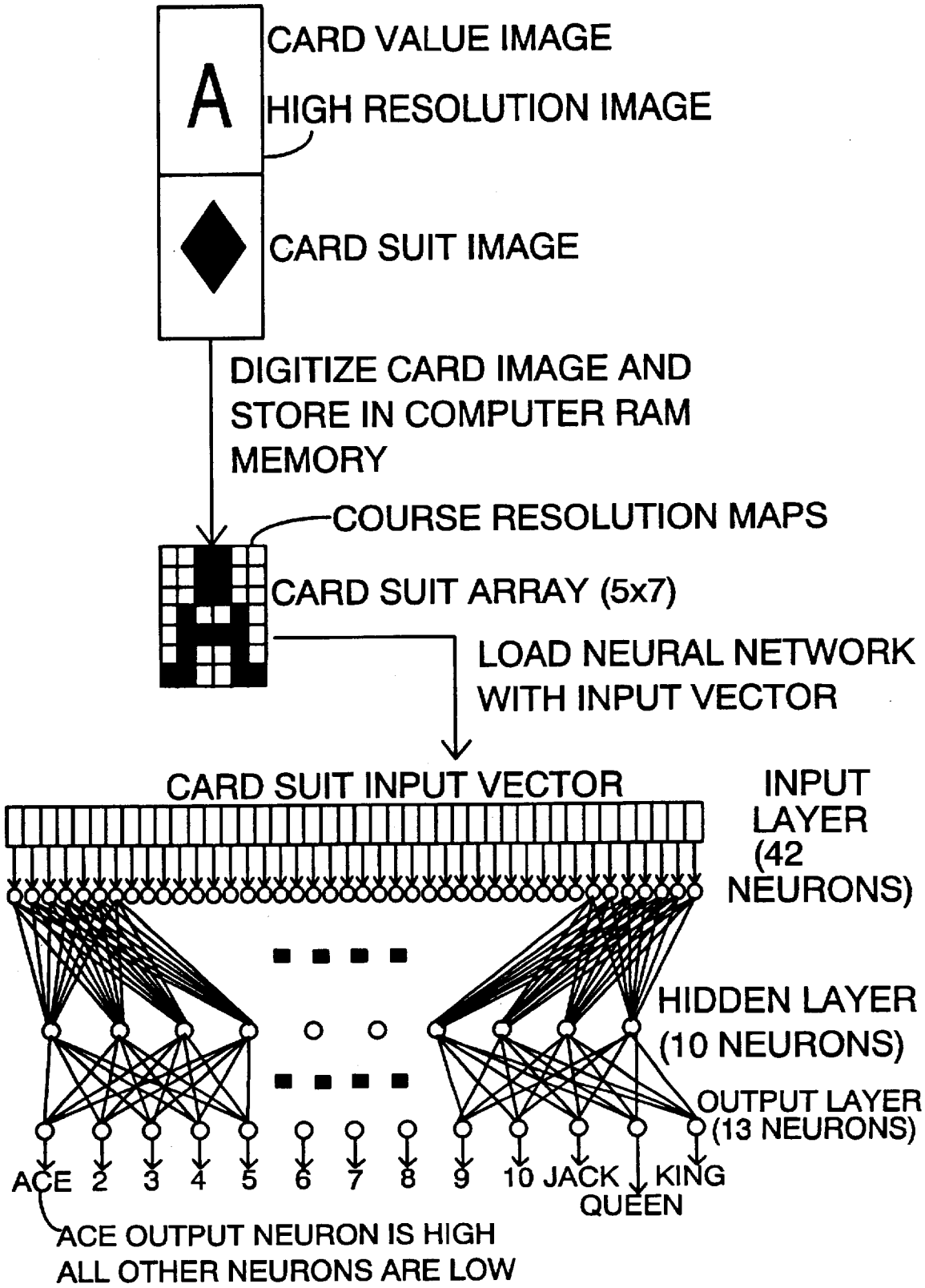

Since the neural network used in this application for card suit identification (see FIG. 8) will map a 42 pixel image to one of four card suits, the neural network will need 42 inputs to represent the image grid, and 4 neurons in its output layer. The neural network used in this application for card value identification (see FIG. 9) will map a 42 pixel image to one of 13 card values and this neural network will need 42 inputs to represent the image grid, and 13 neurons in its output layer. Both neural networks will have a hidden layer to improve the function approximation capabilities.

The networks will be trained to output a 1 in the correct position of the output vector and fill the rest of the output vector with 0s. An example would be if the neural network identified an ACE input vector the first position of the output vector would be 1 and all other positions would be 0.

The neural network will be trained to identify card suits and values using back-propagation. The back-propagation technique adjusts the weights ($W_{ij}$) of each neuron connection until the output vector is correct for the input vector sets that would represent a given card value or suit. After training the values of the weights will be fixed and the network will be able to identify card suit and values for any card presented to the neural network.

What is claimed is:

1. A card delivery shoe for use in dealing playing cards for the playing of a card game comprising:

an elongated housing having a chute for supporting a deck of playing cards for movement toward one end of the housing, said housing having an outlet opening near the front thereof whereby the cards of the deck are removed manually one-by-one out of the housing during the play of a game along the chute in the housing;

means for scanning indicia on each of the cards as they move along said chute whereby a signal is generated which represents the value and suit of the cards as they move one-by-one out of the housing; and means for coupling the scanner to a host computer for processing the signal for determination of the trends in the play of the game in accordance with the way in which the cards are played relative to a card count system, wherein the scanner includes a feed forward neural-network which is trained using error back-propagation to recognize the possible card suits and card values of the cards of a card deck supported on the chute.

2. A shoe as set forth in claim 1, wherein the scanner includes a feed forward neural-network which is trained using error back-propagation to sense and recognize all possible card suits and card values, said sensor being operable to create a two-dimensional bit-mapped image of the card suit and value of the card moving along the path.

3. A shoe as set forth in claim 2, wherein the housing has means for directing a position signal to a computer to indicate the location of a card which moves along said housing toward said outlet opening, means for directing the output signal of the image to a host computer, and means responsive to the host computer for determining that a deck has been penetrated.

4. A shoe as set forth in claim 1, wherein is included a magnetic stripe reader carded by the shoe and coupled to the host computer.

5. A shoe as set forth in claim 1, wherein is included a alpha-numeric keyboard and LCD display carded by the shoe near the rear end thereof and coupled with a signal input line coupled to the computer contained within the shoe to enter and retrieve information to and from a customer's file.

6. A card tracking system comprising a card delivery shoe for use in dealing playing cards for the playing of a card game and a host computer wherein said shoe comprises:

an elongated housing having a chute for supporting a deck of playing cards for movement toward one end of the housing, said housing having an outlet opening near the front thereof whereby the cards of the deck are removed manually one-by-one out of the housing during the play of a game along the chute in the housing;

means for scanning indicia on each of the cards as they move along said chute whereby a signal is generated which represents the value and suit of the cards as they move one-by-one out of the housing;

means for coupling the scanner to a host computer for processing the signal for determination of the trends in the play of the game in accordance with the way in which the cards are played relative to a card count system, wherein the scanner includes a feed forward neural-network which is trained using error back-propagation to recognize the possible card suits and card values of the cards of a card deck supported on the chute;

wherein the scanner has an output signal, and means for coupling the output signal to a host computer, said host computer being programmed to perform the following:

(1) assign a specific numerical value, card suit, and card count value to each card passed over and identified by the scanner;

(2) keep track of the number of cards played from and remaining in the deck and the number of cards played and remaining in each suit of the deck;

(3) calculate a selected card count system running and true counts for the deck being dealt as each card is removed from the deck and at the beginning of each round during real time;

(4) calculate the maximum, minimum and average running and true counts set at the beginning of each round for all decks dealt or issued during a specific time period;

(5) activate an alert display on the shoe to inform the dealer that the house deck penetration has been achieved and this will be the last round dealt from the deck in the shoe before shuffling;

(6) activate an alert display on a remote computer monitor that a specific deck penetration has been reached and that the card count system true count for the current shoe or deck being dealt is favorable to the players.

7. A card delivery method comprising:

directing a group of cards, one-by-one, downwardly along a chute toward one end of a path of travel; scanning indicia on the cards as they move along said path; generating an output signal representing the value and suit of the cards as they move one-by-one out of the housing; and processing the signal for the determination of the trends in the play of the game as played by skilled card count system players wherein the scanning step includes operating a feed forward neural-network which is trained using error back-propagation to recognize the possible card suits and card values of said group of cards on the chute.

8. A method as set forth in claim 7, wherein the scanning step includes actuating a feed forward neural-network which is tried using error back-propagation to sense and recognize all possible card suits and card values of said card group, said sensing step being operable to create a two-dimensional bit-mapped image of the card suit and value of a card moving along the path.

9. A method as set forth in claim 7, wherein is included the step of reading from and writing information on a magnetic stripe by means of a alpha-numeric keyboard and LCD display coupled to the shoe.

10. A method as set forth in claim 7, wherein is included the step of entering information to a customer's file by means of a alpha-numeric keyboard coupled to the shoe.

11. A method as set forth in claim 7, wherein is included the step of displaying on a LCD display data entered to and retrieved from a customer's file by means of a alpha-numeric keyboard coupled to the shoe.

* * * * *

UNITED STATES PATENT AND TRADEMARK OFFICE
CERTIFICATE OF CORRECTION

PATENT NO : 5,722,893

DATED : March 3, 1998

INVENTOR(S) : Hill et al.

It is certified that error appears in the above-identified patent and that said Letters Patent are hereby corrected as shown below:

Col. 4, line 33, delete "from" and replace with --front--;

line 35, delete "frame-mad" and replace with --frame-read--;

line 55, delete "tried" and replace with --trained--.

Col. 5, line 65, delete "dose" and replace with --close--.

Col. 6, line 53, delete "ruing" and replace with --running--.

Col. 9, line 8, delete "carded" and replace with --carried--;

line 11, delete "carded" and replace with --carried--.

Col. 10, line 32, delete "tried" and replace with --trained--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*